US005559087A

United States Patent [19]

Halsrud et al.

[11] Patent Number: 5,559,087

[45] Date of Patent: Sep. 24, 1996

[54] THERMOPLASTIC COMPATIBLE LUBRICANT FOR PLASTIC CONVEYOR SYSTEMS

[75] Inventors: David A. Halsrud, Minneapolis; Timothy A. Gutzmann, Eagan, both of Minn.

[73] Assignee: Ecolab Inc., St. Paul, Minn.

[21] Appl. No.: 267,130

[22] Filed: Jun. 28, 1994

[51] Int. Cl.[6] ..... C10M 145/24

[52] U.S. Cl. ..... 508/579

[58] Field of Search ..... 252/49.3, 49.5, 252/52 A

[56] References Cited

U.S. PATENT DOCUMENTS

| | | | |
|---|---|---|---|
| 2,825,693 | 3/1958 | Beaubien | 252/32.5 |
| 3,350,346 | 10/1967 | Maxson | 260/45.7 |
| 3,352,787 | 11/1967 | Bodach | 252/108 |
| 3,372,117 | 3/1968 | Jones et al. | 252/42.1 |
| 3,374,171 | 3/1968 | Davis | 252/34.7 |
| 3,574,100 | 4/1971 | Wetmore | 252/32.5 |
| 3,583,914 | 6/1971 | Garvin et al. | 252/34.7 |
| 3,672,977 | 6/1972 | Dardoufas | 117/138.8 |
| 3,718,588 | 2/1973 | Bellos et al. | 252/32.5 |
| 3,860,521 | 1/1975 | Aepli et al. | 252/34.7 |
| 3,950,258 | 4/1976 | Imai et al. | 252/33 |
| 4,274,973 | 6/1981 | Stanton et al. | 252/34.7 |
| 4,414,121 | 11/1983 | Aiello | 252/49.5 |
| 4,436,200 | 3/1984 | Hodlewsky et al. | 198/851 |
| 4,521,321 | 6/1985 | Anderson et al. | 252/49.3 |
| 4,595,519 | 6/1986 | Takeno et al. | 252/146 |
| 4,636,321 | 1/1987 | Kipp et al. | 252/49.3 |
| 4,752,527 | 6/1988 | Sanzero et al. | 428/391 |
| 4,789,593 | 12/1988 | Das | 428/391 |
| 4,839,067 | 6/1989 | Jansen | 252/11 |
| 5,009,801 | 4/1991 | Wider et al. | 252/33.2 |
| 5,141,802 | 8/1992 | Parrinello et al. | 428/288 |
| 5,286,300 | 2/1994 | Hnatin et al. | 134/2 |
| 5,334,322 | 8/1994 | Williams, Jr. | 252/52 |

FOREIGN PATENT DOCUMENTS

| | | |
|---|---|---|
| 0137057 | 4/1985 | European Pat. Off. . |
| 0302705 | 2/1989 | European Pat. Off. . |
| 0329891 | 8/1989 | European Pat. Off. . |
| 92/13048 | 8/1992 | WIPO . |
| 93/18121 | 9/1993 | WIPO . |
| 92/13049 | 2/1994 | WIPO . |

*Primary Examiner*—Prince Willis, Jr.
*Assistant Examiner*—Cephia D. Toomer
*Attorney, Agent, or Firm*—Merchant, Gould, Smith, Edell, Welter & Schmidt

[57] ABSTRACT

A method of lubricating plastic conveyor tracks or belts is herein described wherein the lubricant composition contains a block copolymer of ethylene oxide and propylene oxide; also described are methods of manufacture of such lubricant compositions in both concentrate and diluted form. The compositions may also comprise an anionic and a nonionic surfactant as well as a neutralizing agent.

24 Claims, No Drawings

THERMOPLASTIC COMPATIBLE LUBRICANT FOR PLASTIC CONVEYOR SYSTEMS

FIELD OF THE INVENTION

This invention relates to lubricants suitable for use on plastic conveyor systems. More particularly, the invention relates to a conveyor lubricant that increases the lubricity in continuously moving plastic conveyors by lubricating the plastic tracks or belts.

BACKGROUND OF THE INVENTION

In the food and beverage processing industry, the cleaning, filling and labeling of bottles are carried out automatically. The bottles are moved from operation station to operation station on belt conveyors. Since the use of plastic conveyor belts is increasing in the food and beverage industry, there is a need for aqueous-based lubricants that provide excellent lubricity and without showing any detrimental effects on the plastics.

Very little is known about aqueous-based lubricants for plastic conveyor belts, tracks or chains. The type of plastic conveyor system used in the industry is, for example, that described in U.S. Pat. No. 4,436,200.

Lubricants are well known in metal conveyor systems and the role of nonionic surfactants in such systems has been described in U.S. Pat. Nos. 3,372,117 and 4,414,121. Both of these patents describe the use of a block copolymer of ethylene oxide and propylene oxide as a nonionic surfactant in combination with other ingredients for a metal coating lubricant composition for metal conveyor systems.

Nonionic surfactants have also been used in combination with anionic or cationic surfactants in preventing stress cracking of polymers as described in U.S. Pat. No. 3,352,787.

The lubricant described in U.S. Pat. No. 4,436,200, which is directed to plastic conveyor belts, is a dry lubricant made up of fibers imbedded in the thermoplastic. These fibers are uniformly disbursed and consist of tetrafluoroethylene monofilamentous fibers.

It is has now been discovered that the use of block copolymers of ethylene oxide and propylene oxide, commercially known as Pluronics®, manufactured by BASF, can be used as a key ingredient in an aqueous lubricant composition for plastic conveyor systems. Such lubricants show superior lubricity and outperform present marketed lubricants for metal conveyors.

SUMMARY OF THE INVENTION

Accordingly, the present invention is a method of lubricating a continuously moving plastic conveyor system for transporting a container, preferably plastic containers, comprising the step of applying an aqueous thermoplastic compatible lubricant composition to the surface of a plastic belt or track, the aqueous lubricant composition comprising a block copolymer of ethylene oxide and propylene oxide.

In a second aspect, the invention is a method of lubricating said plastic conveyor system by applying an aqueous thermoplastic compatible lubricant composition to the surface of the plastic belt or track, the aqueous lubricant composition comprising a block copolymer of ethylene oxide and propylene oxide, surfactants, preferably a mixture of an anionic and a nonionic surfactant, and a neutralizing agent.

A third aspect of the present invention is a lubricant concentrate commercially available in liquid or solid form, said lubricant concentrate being thermoplastically compatible and employed for and suitable for plastic conveyor systems. The lubricant concentrate comprises from about 1.0 to 100 wt-% of a block copolymer of ethylene oxide and propylene oxide having a molecular weight of about 4,000 to 15,000. Said lubricant concentrate may also contain up to about 50 wt-% of a anionic surfactant, up to about 30 wt-% of a nonionic surfactant, and up to about 10 wt-% of a neutralizing agent.

In a fourth aspect, the invention is an aqueous thermoplastic compatible lubricating composition in which said lubricating composition is applied on plastic conveyor belts or tracks. Said aqueous lubricating composition comprising from about 100–10,000 ppm (parts per million) of a block copolymer of ethylene oxide and propylene oxide having a molecular weight of about 4,000 to 15,000. Said aqueous lubricating composition may also contain up to 5,000 ppm of an anionic surfactant, up to 3,000 ppm of a nonionic surfactant and up to 1,000 ppm of a neutralizing agent.

DETAILED DESCRIPTION OF THE INVENTION

In the food and beverage processing industry, food and beverage containers are often made of thermoplastic material and are transported from one location to another location by plastic belt conveyors. Occasionally, the containers would be stopped on the conveyor due to a back up on the conveyor. While the container is stopped, the belt is moved continuously. To facilitate the smooth transportation of the containers, a lubricating composition is sprayed onto the surface of the conveyor belt. The lubricating composition is typically an aqueous solution obtained by diluting a lubricant concentrate with water in a ratio varying from 1:100 to 1:1000.

One of the reasons for the lubricating composition is to facilitate movement and reduce the damage to the container resulting from mechanical impact between the containers and the rubbing action among the containers and between the containers and the belt.

Accordingly, it is desirable that the lubricating composition has good surfactant properties so that the solution can spread evenly over the surfaces of the belt and the containers, reduce the coefficient of friction between the surfaces, and further have good detergency characteristics to facilitate cleanliness. A necessary characteristic of the lubricating composition is thermoplastic compatibility. A lubricant is considered thermoplastic compatible if in its use, it passes compatibility tests established for the resins.

Other desirable characteristics of the lubricating composition are biodegradability and nontoxicity. The public is increasingly aware of the ecological problems caused by the release of man-made chemicals in the environment. More stringent governmental regulations are being implemented to respond to this public concern. Preferably, the lubricating composition would contain chemicals that are more biodegradable and less toxic than conventional chemicals used in lubricant concentrates.

The invention is a thermoplastic compatible lubricant concentrate that can be mixed with water to form a lubricant for facilitating the transportation of containers on a plastic conveyor system. In particular, the invention comprises the use of a block copolymer of ethylene oxide and propylene oxide as a lubricant for plastic conveyor belts or tracks.

Block Copolymers

Block copolymers of ethylene oxide and propylene oxide are known in the art as nonionic surfactants and are commercially available. The trade name for such block copolymers is Pluronics® and are manufactured by BASF.

The block copolymers of ethylene oxide and propylene oxide of the present invention are not to be considered nonionic surfactants but are to be considered the key ingredient in providing superior lubricity to the plastic conveyor systems on belts and tracks. The block copolymers range in molecular weight from about 800 to about 20,000. Preferred copolymers are those having a molecular weight range of about 4,000 to 15,000.

One type of ethylene oxide/propylene oxide copolymer used in the present invention is that wherein the polymer is prepared by the controlled addition of propylene oxide to the two hydroxyl groups of propylene glycol. Ethylene oxide is then added to sandwich this hydrophobe between hydrophilic groups, controlled by length to constitute from 10% to 80% (by weight) of the final molecule. This type of polymer is best illustrated by the following formula:

$$HO-(CH_2CH_2O)_x-(CH_2\overset{\overset{CH_3}{|}}{C}HO)_y-(CH_2CH_2O)_x,-H$$

The x and y in the formula have no definite integers, but depend on the amount of ethylene oxide and propylene oxide in the desired polymer. In this case, ethylene oxide constitutes anywhere from 10 to 80 wt-%.

A second type of block copolymer of the present invention is that prepared by adding ethylene oxide to ethylene glycol to provide a hydrophile of designated molecular weight. Propylene oxide is then added to obtain hydrophobic blocks on the outside of the molecule thereby creating another sandwich. The structure of this polymer is illustrated as follows:

$$HO-(\overset{\overset{CH_3}{|}}{C}H-CH_2O)_x-(CH_2CH_2O)_y-(CH_2\overset{\overset{CH_3}{|}}{C}HO)_x,-H$$

The content of ethylene oxide can range from 10 to 80 wt-%.

The block copolymers of the present invention used as lubricants for plastic conveyor systems are in liquid, paste or solid form and can be used alone or in combination with other ingredients. The preferred block copolymers are those between the molecular weight range of 4,000 to 15,000 and comprise polypropylene oxide sandwiched by polyethylene oxide blocks wherein the ethylene oxide constitutes from about 10 to 80 wt-% of a copolymer. The most preferred of the block copolymers is that polymer identified as Pluronic® F-108, which has an average molecular weight of 14,600, a melt/pour point of 57° C., is a solid at room temperature with a viscosity of 2,800 cps at 77° C. and a surface tension in dynes/cm of 41 at 25° C., @0.1%.

Other active ingredients may be used to improve the effectiveness of the lubricant. For example, the lubricant concentrate may also contain surfactants, cationic, anionic and nonionic. Preferred are mixtures of anionic and nonionic surfactants. For a discussion on surfactants, see Kirk-Othmer, Surfactants in *Encyclopedia of Chemical Technology*, 19:507–593 (2d Ed. 1969), which is incorporated by reference herein.

Anionic surfactants suitable for use for this invention include carboxylates, sulfates, sulfonates, phosphates, and mixtures thereof. Preferred anionic surfactants are the phosphates. Preferred phosphates are alkyl orthophosphates such as stearyl acid phosphate, alkyl polyphosphates and alkyl ether phosphate (alkyl phosphate ester). The preferred phosphate esters have alkyl chains with 8 to 16 carbon atoms. A more preferred phosphate is a linear alcohol alkylate phosphate ester, particularly a $C_8$ to $C_{10}$ alcohol ethoxylate phosphate ester. Also preferable are alkaline salts of $C_{10}$–$C_{18}$ saturated and unsaturated fatty acids, such as, for example, tall oil, oleic or coconut oil. Particularly useful is sodium tall oil soap. When used in the lubricant concentrate, it is preferable that an anionic surfactant be present in a range of about 1–50 wt-%.

Cationic cosurfactants suitable for use in this invention include quaternary ammonium surfactants with one or two long chain fatty alkyl groups and one or two lower alkyl or hydroxyalkyl substituents. Preferable examples are alkylbenzyl dimethyl ammonium chloride wherein the alkyl groups are a stearyl, tallow, lauryl, myristyl moiety, and the like, and mixtures thereof.

Nonionic surfactants include polyalkylene oxide condensates of long chain alcohols such as alkyl phenols and aliphatic fatty alcohols. Preferable examples contain alkyl chains of $C_6$ to $C_{18}$. Typical examples are polyoxyethylene adducts of tall oil, coconut oil, lauric, stearic, oleic acid, and the like, and mixtures thereof. Other nonionic surfactants can be polyoxyalkylene condensates of fatty acid amines and amides having from about 8 to 22 carbon atoms in the fatty alkyl or acyl groups and about 10 to 40 alkyloxy units in the oxyalkylene portion. An exemplary product is the condensation product of coconut oil amines and amides with 10 to 30 moles of ethylene oxide. It is possible to form a block copolymer by condensing different alkylene oxides with the same fatty acid amine or amide. An example is a polyoxalkylene condensate of a long chain fatty acid amine with three blocks of oxyalkylene units wherein the first and third block consists of propylene oxide moiety and the second block consists of ethylene oxide moiety. The block copolymer may be linear or branched.

Yet another kind of nonionics are alkoxylated fatty alcohols. Typical products are the condensation products of n-decyl, n-dodecyl, n-oxtadecyl alcohols, and a mixture thereof with 3 to 50 moles of ethylene oxide.

Preferred nonionics for the present lubricant compositions are alkylene oxide adducts of relatively low degree of polymerization alkylglycosides. These oxyalkylated glycosides comprise a fatty ether derivative of a mono-, di-, tri-, etc. saccharide having an alkylene oxide residue. Preferable examples contain 1 to 30 units of an alkylene oxide, typically ethylene oxide, 1 to 3 units of a pentose or hexose, and an alkyl group of a fatty group of 6 to 20 carbon atoms. An oxyalkylated glycoside compares with the general formula of $$H-(AO)_m-G_y-O-R$$

where AO is an alkylene oxide residue; m is the degree of alkyl oxide substitution having an average of from 1 to about 30, G is a moiety derived from a reducing saccharide contain 5 of 6 carbon atoms, i.e. pentose or hexose; R is saturated or nonsaturated fatty alkyl group containing 6 to 20 carbon atoms; and 6, the degree of polymerization (D.P.) of the polyglycoside, represents the number of monosaccharide repeating units in the polyglycoside, is an integer on the basis of individual molecules, but may be an noninteger when taken on an average basis when used as an ingredient for lubricants.

In this invention, the more preferred are sorbitan fatty acid esters and the polyoxyethylene derivatives of sorbitan and fatty acid esters known as the Tweens®. These are the polyoxyethylene sorbitan and fatty acid esters prepared from sorbitan and fatty esters by addition of ethylene oxide. Particularly valuable of these are polysorbate 20, or polyoxyethylene 20 sorbitan 10R8, polysorbate 40, or polyoxyethylene 20 sorbitan monopalmatate, polysorbate 60, or polyoxyethylene 20 sorbitan monostearate, or polysorbate 85, or polyoxyethylene 20 sorbitan triolyate. Used in the lubricant concentrate of the present invention, it is preferable that the nonionic surfactant be present in a range of about 1–50 wt-%.

Alternatively, a more preferred nonionic surfactant used in the present lubricant concentrate is an alkylpolyglycoside. Alkylpolyglycosides (APGs) also contain a carbohydrate hydrophile with multiple hydroxyl groups.

APGs are fatty ether derivatives of saccharides or polysaccharides. In this invention, the saccharide or polysaccharide groups are mono-, di-, tri-, etc. saccharides of hexose or pentose, and the alkyl group is a fatty group with 7 to 20 carbon atoms. Alkylpolyglycoside can be compared with the general formula of $$G_x—O—R$$

where G is a moiety derived from a reducing saccharide contain 5 of 6 carbon atoms, i.e. pentose or hexose; and R is saturated or nonsaturated fatty alkyl group containing 6 to 20 carbon atoms; x, the degree of polymerization (D.P.) of the polyglycoside, representing the number of monosaccharide repeating units in the polyglycoside, is an integer on the basis of individual molecules, but may be a noninteger when taken on an average basis when used as an ingredient for lubricants. In this invention, preferably x has the value of less than 2.5, and more preferable is within the range between 1 and 2.

The reducing saccharide moiety, G can be derived from pentose or hexose. Exemplary saccharides are glucose, fructose, mannose, galactose, talose, gulose, allose, altrose, idose, arabinose, xylose, lyxose and ribose. Because of the ready availability of glucose, glucose is a preferred embodiment in the making of polyglycosides.

The fatty alkyl group preferably is a saturated alkyl group, although unsaturated alkyl fatty group may be used. It is also possible to use an aromatic group such as alkylphenyl, alkylbenzyl and the like in place of the fatty alkyl group to make an aromatic polyglycoside.

Generally, commercially available polyglycosides have alkyl chains of $C_8$ to $C_{16}$ and average degree of polymerization of 1.4 to 1.6. Typically, a belt lubricant concentrate of the present invention optionally contains about 1 wt-% to about 50 wt-% and preferably about 3 wt-% to 10 wt-% of alkylpolyglycoside. When the concentrate is diluted for use, it is preferable that the alkylpolyglycoside be present in the dilute lubricating solution in a concentration of about 10 ppm to about 5,000 ppm.

Many surfactants are most effective in the neutral pH range. Moreover, acid conditions might lead to chemical attack on the same thermoplastics. It is preferable that the available acid from the surfactants employed, e.g. the phosphates, be neutralized to a more neutral pH. Though a lubricant concentrate can be formulated with pH in a wide alkaline or acidic range, it is preferable that the range be between 5 and 10, and more preferably between 6 and 9. The commonly used neutralizing agents are the alkaline metal hydroxides such as potassium hydroxide and sodium hydroxide. Another class of neutralizing agent is the alkyl amines, which may be primary, secondary, or tertiary or, preferably, alkanolamines, such as monoethanolamine, diethanolamine and triethanolamine.

Fatty alkyl substituted amines can also be used as neutralizing agents wherein the first substitute group of the amine is a saturated or unsaturated, branched or linear alkyl group having between 8 to 22 carbon atoms, alkyl group or hydroxyalkyl group having 1 to 4 carbons, or an alkoxylate group, and the third substitute group of the amine is an alkylene group of 2 to 12 carbons bonded to a hydrophilic moiety such as $—NH_2$, —OH, $SO_3$, amine alkoxylate, alkoxylate, and the like. These amines can be illustrated by the formula:

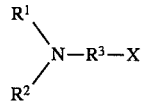

III wherein $R_1$ is an alkyl group having between 8 to 22 carbon atoms, and $R_2$ is a hydrogen, alkyl group or hydroxyalkyl group having 1 to 4 carbons or an alkoxylate group, $R_3$ is an alkylene group having from 2 to 12 carbon atoms, and X is a hydrogen or a hydrophilic group such as $—NH_2$, —OH, $—SO_3$, amine alkoxylate, amine alkoxylate, alkoxylate, and the like.

Examples of amines useful for neutralization are: dimethyl decyl amine, dimethyl octyl amine, octyl amine, nonyl amine, decyl amine, ethyl octyl amine, and the like, and mixtures thereof.

When X is $—NH_2$, preferable examples are alkyl propylene amines such as N-coco-1,3,diaminopropane, N-tallow-1,3,diaminopropane and the like, or mixtures thereof.

Examples of preferable ethoxylated amines are ethoxylated tallow amine, ethoxylated coconut amine, ethoxylated alkyl propylene amines, and the like, and mixtures thereof.

Generally, when added into the lubricant concentrate, the neutralizing agent is present in the range of about 1.0% to about 15% by weight.

In a lubricant concentrate, stabilizing agents, or coupling agents can be employed to keep the concentrate homogeneous under cold temperature. Some of the ingredients may have the tendency to phase separate or form layers due to the high concentration. Many different types of compounds can be used as stabilizers. Examples are isopropyl alcohol, ethanol, urea, octane sulfonate, glycols such as hexylene glycol, propylene glycol and the like.

Dispersing agents may also be added. Examples of suitable dispersing agents include triethanolamine, alkoxylated fatty alkyl monoamines and diamines such as coco bis (2-hydroxyethyl)amine, polyoxyethylene(5-)coco amine, polyoxyethylene(15)coco amine, tallow bis(-2 hydroxyethyl)amine, polyoxyethylene(15)amine, polyoxyethylene(5)oleyl amine and the like.

Although lubricants can be manufactured and sold in dilute form, they are preferably sold as concentrates because of the ease of handling and shipping cost. A lubricant concentrate may be substantially solid, having less than about 1 wt-% of a carrier fluid for carrying the various ingredients of the lubricant. It is, however, preferable that the lubricant concentrate have a carrier fluid. The carrier fluid aids in the dispensing and dilution of the concentrate in water before application on the conveyor belt and thermoplastic containers.

Water is the most commonly used and preferred carrier for carrying the various ingredients in the formulation of the lubricant concentrate. It is possible, however, to use a water-soluble solvent, such as alcohols and polyols. These solvents may be used alone or with water. Example of suitable alcohols are ethanol, propanol, butanol. Examples of polyols are glycerol, ethylene glycol, propylene glycol, diethylene glycol, and the like, as well as mixtures thereof. Generally, when added into the lubricant concentrate, the carrier is present in the range of about 1% to 90% by weight. When the lubricant is diluted in water for applying to a belt, water may be present in the diluted lubricating solution in the range of about 90% to 99.9 wt-%.

Typically the lubricant concentrate is diluted with water in a concentrate/water ratio of 1:100 to 1:1000 before using. In another aspect of the invention, a method of lubricating a continuously-moving plastic conveyor system for transporting a container is practiced by applying diluted aqueous thermoplastic compatible lubricating composition to the surface of the plastic conveyor. This application may be by means of spraying, immersing, brushing and the like. The dilution may be done either batchwise by adding water into a container with a suitable amount of the concentrate or continuously online. Online dilution is usually done by the regulated injection of a stream of concentrate into a stream of water at a steady rate. The injection of the concentrate can be achieved by a pump, for example, metering pump, although other injection means are possible. Water of varying quality, for example, tap water, soft water, and deionized water may be used. The water may also be heated.

In addition to the aforementioned ingredients, it is possible to include other chemicals in the lubricant concentrates. For example, where soft water is unavailable and hard water is used for the dilution of the lubricant concentrate, there is a tendency for the hardness cations, such as calcium, magnesium, and ferrous ions, to reduce the efficacy of the surfactants, and even form precipitates when coming into contact with ions such as sulfates, and carbonates. Sequestrants can be used to form complexes with the hardness ions. A sequestrant molecule may contain two or more donor atoms which are capable of forming coordinate bonds with a hardness ion. Sequestrants that possess three, four, or more donor atoms are called tridentate, tetradentate, or polydentate coordinators. Generally the compounds with the larger number of donor atoms are better sequestrants. The preferable sequestrant is ethylene diamine tetracetic acid (EDTA). Versene is a $Na_4EDTA$ sold by Dow Chemicals. Examples of other sequestrants are: trans-1,2-diaminocyclohexane tetracetic acid monohydrate, diethylene triamine pentacetic acid, sodium salt of nitrilotriacetic acid, pentasodium salt of N-hydroxyethylene diamine triacetic acid, trisodium salt of N,N-di(beta-hydroxyethyl)glycine, and sodium salt of sodium glucoheptonate.

Likewise, additional ingredients may be included to improve the various properties of the lubricant concentrate. For example, ingredients may be added to improve the flowability, viscosity, stability, shelf stability against microbe attack, etc.

In a preferred embodiment, a thermoplastic compatible lubricant concentrate suitable for a continuously moving plastic conveyor system consists essentially of: from about 10 to 75 wt-% of a block copolymer of ethylene oxide and propylene oxide having a molecular weight of about 4,000 to 15,000; from about 1 to 50 wt-% of an anionic surfactant; from about 1 to 50 wt-% of a nonionic surfactant; and from about 1 to 15 wt-% of a neutralizing agent.

In a preferred embodiment of a diluted aqueous thermoplastic compatible lubricating composition, the aqueous lubricating composition consists essentially of: from about 100 to 7,500 ppm of a block copolymer of ethylene oxide and propylene oxide having a molecular weight of about 4,000 to 15,000; from about 10 to about 5,000 ppm of an anionic surfactant; from about 10–5,000 ppm of a nonionic surfactant; and from about 1 to about 1,500 ppm of a neutralizing agent.

Thus, the use solution range is 1:100–1:1000 (1.0% to 0.1%) in water.

The composition as a concentrate can either be a liquid or a solid depending on the choice and concentrations of raw materials.

For a more complete understanding of the invention, the following examples are given to illustrate the embodiment. These experiments are to be understood as illustrative and not limited. All parts are by weight, except where it is contrarily indicated.

The determination of the lubricity of the lubricant concentrate is measured on a short track conveyor system. The conveyor belt is a Rexnord LF (polyacetal) plastic conveyor belt. PET (polyethyleneterephthalate) bottles are the load. The conveyor is driven by a motor which is set at 100 ft/min. The diluted lubricating composition is applied on the bottles and the track by spraying through a nozzle. Typically, a 1:1000 diluted solution is used although a different concentration can be tested as needed. Twenty to sixty bottles are stacked in a rack on the track. The rack is connected to a strain gauge by a wire. As the belt moves, force is exerted on the strain gauge by the pulling action of the rack on the wire. The pull strength is recorded by a computer. The test is run for one hour, the pull strength and coefficient of friction from the 15 minutes to 45 minutes are averaged. The coefficient of friction is calculated on the basis of the measured force and the mass of the bottles. Different lubricants are compared by the pull strength and coefficient of friction.

The thermoplastic compatibility of the lubricating aqueous composition is determined by applying the diluted lubricating composition on a pressurized container and observing for crack patterns. Standard 2 liter thermoplastic bottles are filled with water and placed in a refrigerator over night. Then the mass of the water in each bottle is adjusted to 1800 g. A bottle is immediately capped after 30 g each of sodium bicarbonate and citric acid are added. The sodium bicarbonate and citric acid will generate $CO_2$ in the container and pressurize the bottle. One bottle is checked on the Zahn-Nagel gauge to confirm a pressure that is within a set range (4.9–5.0 volumes). The bottles are set at room temperature overnight. A lubricating solution is made by diluting the lubricant concentrate with water at 1:50 ratio. Two hundred mils of lubricating solution is foamed for 12 bottles by whipping with an electric beater for 5 minutes. The foamed lubricating solution is spread on the bottom of a plastic container. The bottles are then set in the foam. The bottles are then placed in a chamber at 100° F. with 85% relative humidity for two weeks. After two weeks, the bottles are removed from the chamber, observed for crazes, creases and crack patterns on the bottom, and compared with control bottles that have been placed in a standard lubricant (See Example 1A) under similar conditions.

EXAMPLE 1

Lubricity was measured on a short track conveyor system as described above. Conveyor belt was a plastic, pulicidal belt from Rexnord, a Rexnord LF plastic conveyor belt. Polyethyleneterephthalate bottles (PET) were the load. The conveyor system was run at a speed of 100 ft./min. and a load of 22.41Kg. The use solution flow rate was 2,600 ml./hr.

The following materials were mixed together and stirred on a hot plate until homogenous.

| Weight | Material |
|---|---|
| 100 g | Pluronic ® F-108, ethylene oxide propylene oxide block copolymer |
| 52.46 g | Emphos PS-236 (WITCO CHEM.), complex organo phosphate acid ester |
| 11.84 g | KOH, 45% |
| 35.68 g | Polyoxyethylene 20 sorbitan monostearate |

Examples of the above material were tested on the short track conveyor. Soft water was used for all the testing. The concentrations tested were 0.025%, 0.010% and were compared to 0.1% of a commercially available standard lubricant composition for metal conveyor systems. Results show that at even at 1/10th the concentration of the standard, the lubricant of the example showed a lower coefficient of friction.

EXAMPLE 1A

Standard Composition

A commercial lubricant product PETGUARD™ was used for comparative testing with the compositions of the present invention.

PETGUARD™ comprises, in an aqueous base 12% of a fatty acid, 15% higher alkylamine ethoxylate, 20% alkyl aryl sulfonate coupling agent, 1.5% of an alkyl diamine, and 4% chelating agent.

EXAMPLE 2

A lubricant composition was prepared by stirring the contents below by warming on a hot plate.

| Weight | Percentage | Material |
|---|---|---|
| 25 g | 50.0 | Pluronic ® F-108 |
| 8.92 g | 17.8 | Polyoxyethylene 20 sorbitan monostearate |
| 13.12 g | 26.3 | $C_8$–$C_{10}$ alcohol ethoxylate phosphate ester |
| 2.96 | 5.9 | KOH, 45% |

This sample was also tested and compared to the standard composition of Example 1A and showed a lower coefficient of friction. This lubricant composition also compared favorably to the standard 1A composition in a PET bottle stress cracking test. No stress cracking was observed.

EXAMPLE 3

| Percentage | Material |
|---|---|
| 1.5 | Pluronic ® F-108 |
| 24.0 | Polyoxyethylene 20 sorbitan monooleate |
| 25.0 | $C_8$–$C_{10}$ alcohol ethoxylate phosphate ester |
| 10.0 | Sodium Tall Oil Soap |
| 5.0 | $Na_4$ EDTA |
| 4.0 | NAOH, 50% |
| 0.5 | Silicone defoamer |

The above ingredients were mixed to form a lubricant composition as in Examples 1 and 2.

EXAMPLE 4

Individual materials were tested for lubricity as compared to the lubricant composition of Example 1A and that of Examples 1 and 2.

A 0.025% soft water solution of Pluronic® F-108 was tested on the short track plastic conveyor. It had the lowest coefficient of friction than any of the other samples or compositions tested.

A similar concentration (0.025%) soft water solution of Pluronic® P-105 was tested as a lubricant, but did not perform as well as F-108 or the composition of Examples 1 and 2 or the standard 1A.

In the same diluted concentration, individual components such as polyoxyethylene 20 sorbitan monostearate and sodium tall oil soap were tested for lubricity. Both compounds individually scored poorly and were worse than any of the compositions which contained such components.

What is claimed is:

1. A method of lubricating a continuously moving plastic conveyor system for transporting a container, comprising the step of applying an aqueous thermoplastic compatible lubricant composition to the surface of a plastic belt or track, the aqueous lubricant composition comprising a block copolymer of ethylene oxide and propylene oxide.

2. The method of claim 1, wherein the block copolymer of ethylene oxide and propylene oxide has a molecular weight of about 800 to 20,000.

3. The method of claim 2, wherein the molecular weight of the block copolymer is about 4,000 to 15,000.

4. The method of claim 3, wherein the block copolymer comprises polyoxypropylene sandwiched by polyoxyethylene blocks wherein ethylene oxide constitutes from about 10 to 80 wt-% of the copolymer.

5. The method of claim 3, wherein the block copolymer comprises polyoxyethylene sandwiched by polyoxypropylene blocks wherein ethylene oxide constitutes from about 10 to 80 wt-% of the copolymer.

6. The method of claim 1, wherein the aqueous lubricant composition further comprises a surfactant or mixtures thereof.

7. The method of claim 1, wherein the aqueous lubricant composition further comprises an anionic and a nonionic surfactant.

8. The method of claim 7, wherein the anionic surfactant is an organophosphate acid ester.

9. The method of claim 7, wherein the nonionic surfactant is a sorbitan fatty acid ester or a polyoxyethylene derivative thereof, or an alkylpolyglycoside.

10. The method of claim 1, wherein the aqueous lubricant composition further comprises a neutralizing agent.

11. The method of claim 10, wherein the neutralizing agent is selected from the group consisting of sodium hydroxide, potassium hydroxide, monoethanolamine, diethanolamine and triethanolamine.

12. A method of lubricating a continuously moving plastic conveyor system for transporting a container, comprising the step of applying an aqueous thermoplastic compatible lubricant composition to the surface of a plastic belt or track, the aqueous lubricant composition comprising:

(a) from about 100 ppm to about 7,500 ppm of a block copolymer of ethylene oxide and propylene oxide;

(b) from about 10 ppm to about 5,000 ppm of an anionic surfactant;

(c) from about 10 ppm to about 5,000 ppm of a nonionic surfactant; and (d) from about 1 ppm to about 1,500 ppm of a neutralizing agent.

13. The method of claim 12, wherein the molecular weight of the block copolymer is about 4,000 to 15,000.

14. The method of claim 13, wherein the block copolymer comprises polyoxypropylene sandwiched by polyoxyethylene blocks wherein ethylene oxide constitutes from about 10 to 80 wt-% of the copolymer.

15. The method of claim 13, wherein the block copolymer comprises polyoxyethylene sandwiched by polyoxypropylene blocks wherein ethylene oxide constitutes from about 10 to 80 wt-% of the copolymer.

16. The method of claim 12, wherein the anionic surfactant is an organophosphate acid ester.

17. The method of claim 12, wherein the nonionic surfactant is a sorbitan fatty acid ester or a polyoxyethylene derivative thereof, or an alkylpolyglycoside.

18. The method of claim 12, wherein the neutralizing agent is selected from the group consisting of sodium hydroxide, potassium hydroxide, monoethanolamine, diethanolamine and triethanolamine.

19. An aqueous thermoplastic compatible lubricating composition suitable for use in continuously moving plastic conveyor belts or tracks, the aqueous lubricating composition consisting of:

(a) about 100 to 7,500 ppm of a block copolymer of ethylene oxide and propylene oxide having a molecular weight of about 4,000 to 15,000;

(b) about 10 to 5,000 ppm of an anionic surfactant;

(c) about 10 to 5,000 ppm of a nonionic surfactant; and (d) about 1 to 1,500 ppm of a neutralizing agent.

20. The aqueous lubricating composition of claim 19, wherein the block copolymer is a polyoxypropylene sandwiched by polyoxyethylene blocks wherein ethylene oxide constitutes from about 10 to 80 wt-% of the copolymer.

21. The aqueous lubricating composition of claim 19, wherein the block copolymer is polyoxyethylene sandwiched by polyoxypropylene blocks wherein ethylene oxide constitutes from about 10 to 80 wt-% of the copolymer.

22. The aqueous lubricating composition of claim 19, wherein the anionic surfactant is an organophosphate acid ester.

23. The aqueous lubricating composition of claim 19, wherein the nonionic surfactant is a sorbitan fatty acid ester or a polyoxyethylene derivative thereof, or an alkylpolyglycoside.

24. The aqueous lubricating composition of claim 19, wherein the neutralizing agent is selected from the group consisting of sodium hydroxide, potassium hydroxide, monoethanolamine, diethanolamine and triethanolamine.

* * * * *